US011732900B2

(12) United States Patent
Simonato et al.

(10) Patent No.: US 11,732,900 B2
(45) Date of Patent: Aug. 22, 2023

(54) METHOD FOR OPERATING A COOKING OVEN

(71) Applicant: ELECTROLUX PROFESSIONAL S.P.A., Pordenone (IT)

(72) Inventors: Michele Simonato, Pordenone (IT); Riccardo Furlanetto, Pordenone (IT); Eleonora Pippia, Pordenone (IT); Emidio Tiberi, Pordenone (IT)

(73) Assignee: Electrolux Professional S.P.A., Pordenone (IT)

( * ) Notice: Subject to any disclaimer, the term of this patent is extended or adjusted under 35 U.S.C. 154(b) by 76 days.

(21) Appl. No.: 17/422,085

(22) PCT Filed: Feb. 21, 2020

(86) PCT No.: PCT/EP2020/054691

§ 371 (c)(1),
(2) Date: Jul. 9, 2021

(87) PCT Pub. No.: WO2020/173840

PCT Pub. Date: Sep. 3, 2020

(65) Prior Publication Data

US 2022/0099303 A1 Mar. 31, 2022

(30) Foreign Application Priority Data

Feb. 26, 2019 (EP) ..... 19159496

(51) Int. Cl.
*F24C 7/08* (2006.01)
*F24C 3/12* (2006.01)

(52) U.S. Cl.
CPC ..... *F24C 7/085* (2013.01); *F24C 3/128* (2013.01); *F24C 7/086* (2013.01); *F24C 7/087* (2013.01)

(58) Field of Classification Search
CPC ..... F24C 7/087; F24C 3/128; F24C 7/085; F24C 7/086
See application file for complete search history.

(56) References Cited

U.S. PATENT DOCUMENTS

2013/0156917 A1* 6/2013 Cescot ..... F24C 7/08 426/523
2019/0234617 A1* 8/2019 Bhogal ..... F24C 3/124

FOREIGN PATENT DOCUMENTS

EP 2 604 931 A1 6/2013

* cited by examiner

*Primary Examiner* — Thien S Tran
(74) *Attorney, Agent, or Firm* — Stites & Harbison, PLLC; David W. Nagle, Jr.

(57) ABSTRACT

The present invention is a method for operating a cooking oven comprising: a cooking chamber; a heating device for heating foodstuff contained in the cooking chamber; a database wherein cooking cycles are stored; a control unit operatively connected to the database and to the heating device, configured for activating/deactivating the heating device according to the cooking cycles; and a user interface operatively connected to the control unit. The method comprises the following phases: (a) selecting, by the user interface, a new list of two or more of cooking cycles stored in the database, to be executed in sequence; (b) sorting, by the control unit, the cooking cycles of the new list, using a sorting algorithm that calculates the order of the cooking cycles of the new list and (c) displaying, via the user interface, a sorted list containing the cooking cycles of the new list.

14 Claims, 7 Drawing Sheets

METHOD FOR OPERATING A COOKING OVEN

The present invention relates to a method for operating a cooking oven, preferably a "professional" oven, i.e. an oven used in professional activities, like restaurants, canteens, hotels, etc.

Commonly, in professional activities (e.g. restaurants, canteens, etc.), to prepare banquets, buffets, and in all that cases in which a plurality of different dishes has to be served, it is known cooking some dishes in advance, and, for example, keeping them warm until serving, or cooling them down (e.g. using a blast-chiller) and heating them again immediately before being served.

In these cases, therefore, different kind of dishes can be cooked one after the other in the same oven, and the serving time is not related to the cooking order.

Since the energy consumption of an oven (in particular of professional ovens) is quite high, some solutions have been developed in the art for trying to reduce the overall energy consumption for cooking in sequence a plurality of dishes.

For example, EP 2 604 931, of the same applicant, discloses a cooking equipment comprising an oven cavity, at least one energy source operable to heat food placed inside the oven cavity, a control device provided with a first database containing a plurality of cooking programs stored therein, each cooking program comprising at least a start cooking temperature; the cooking equipment comprises a user interface operable to select a set of cooking programs to be performed by the cooking equipment from the plurality of cooking programs stored in the first database. It also comprises a processing unit configured to sort the set of cooking programs selected through the user interface on the basis of energetic constraints, and a regulating module configured to drive at least one energy source in accordance with the sorted set of cooking programs.

Even if this solution is quite effective for minimizing the overall energy consumption required for executing in sequence a set of cooking programs (called also "cooking cycles" in the present application), it is not completely satisfying, since it sorts the cooking programs relaying on general energetic constrains (e.g.: giving precedence to convective cooking programs with respect to steam cooking programs, sorting the convective cooking cycles by decreasing start cooking temperature, and sorting the steam cooking programs by decreasing cooking humidity) which do not take into account the actual energy required for passing from a cooking program/cycle to the following.

In fact, it could happen that, due to the specific temperature and humidity set for a steam cooking cycle, performing such a steam cooking cycle before a convective cycle could require less energy than performing such a steam cooking cycle after the convective cooking cycle.

In addition, known solutions don't take into account the effect of "multiphase cooking programs", which use different temperature set points at the beginning and at the end of the cooking cycle. The aim of the present invention is therefore to provide an effective method for operating a cooking oven for obtaining a prefixed result, at least partially related to energy consumption (for example, minimizing the overall energy consumption), when executing a plurality of cooking cycles in sequence.

It is underlined that stating that the prefixed result is "at least partially related to energy consumption" means that such a result has to be related to energy consumption, but optimizing energy consumption is not necessarily the only or the main aim that drives the sorting of a plurality of cooking cycles to be executed in sequence.

Applicant has found that an effective way for obtaining a prefixed result, at least partially related to energy consumption, when executing in sequence a series of cooking cycles, is sorting these cooking cycles using a sorting algorithm that calculates the order of said cooking cycles for obtaining such a prefixed result, basing the calculation on the pre-set starting temperature, the pre-set final temperature, the pre-set starting humidity and the pre-set final humidity of the cooking cycles to be sorted.

The cited prior art uses a prefixed sorting criteria assuming that it takes to the minimum energy consumption, but without taking into account the real values of the initial and end temperatures and humidity of the different cooking cycles, values which affect the actual energy consumption for passing from a cooking cycle to the following; on the contrary, the method according to the invention takes into account the actual values of the initial and end temperatures and humidity of the different cooking cycles, which affect the energy consumption for passing from a cooking cycle to the following.

It is underlined that basing the sorting on these temperature and humidity parameters corresponds to take into account only transient phases between consecutive cooking cycles, e.g. the preheating and the cooling-down phases; what happens during the cooking cycles does not affect the calculation, since in any case the cooking cycles are bound to their pre-set initial and final values of temperature and humidity. This makes the sorting very reliable. In particular, above aim and objects are solved by a method for operating a cooking oven comprising:

- a cooking chamber wherein foodstuff can be loaded;
- a heating device for heating foodstuff contained in the cooking chamber;
- a database wherein cooking cycles are stored, each cooking cycle having a pre-set starting temperature, a pre-set final temperature, a pre-set starting humidity, a pre-set final humidity;
- a control unit operatively connected to the database and to the heating device, configured for activating/deactivating the heating device according to the cooking cycles;
- a user interface operatively connected to the control unit, configured for allowing a user to interact with the control unit;

wherein the method comprises the following phases:

a) selecting, by the user interface, a new list of two or more of cooking cycles stored in the database, to be executed in sequence;

b) sorting, by the control unit, the cooking cycles of the new list, using a sorting algorithm that calculates the order of the cooking cycles of the new list taking to a prefixed result, at least partially related to the energy consumption, when performed in sequence, basing the calculation on the pre-set starting temperature, the pre-set final temperature, the pre-set starting humidity and the pre-set final humidity of the cooking cycles of the new list;

c) displaying, via the user interface, a sorted list containing the cooking cycles of the new list, sorted according to phase b).

Preferably, the prefixed result comprises a minimization of the overall energy consumption for executing in sequence all the cooking cycles of the new list, or a minimization of the overall energy consumption for executing in sequence all the cooking cycles of the new list, subordinate to one or more not-energy-related constraints.

For example, the not-energy-related constraints can be performing the cooking cycles of a specific kind after (or before) all the others; in this case, minimizing the overall energy consumption for executing in sequence all the cooking cycles, subordinate to the not-energy-related constraints, means minimizing the overall energy consumption performing anyway all the cooking cycles of a specific kind after (or before), all the others. It is underlined that fulfilling the not-related energy consumption could take to a sorted list which overall energy consumption is higher than the overall energy consumption of the same cooking cycles ordered in a different way, for example with the aim of minimizing the overall energy consumption without any other constraint.

In an advantageous embodiment, the sorting algorithm calculates, for a plurality of couples of cooking cycles of the new list, the energies required for passing from one to the other cooking cycle of the couple, and vice versa, basing the calculation on the pre-set starting temperature, the pre-set final temperature, the pre-set starting humidity and the pre-set final humidity of the cooking cycles of such couple, and sorts the cooking cycles of the new list basing the sorting on these energies.

Preferably, the user interface, comprises a touch-screen, a display and a keyboard, switches, knob(s), etc.

Advantageously, the database can be stored/memorized in a suitable memory module, preferably embedded in the control unit, or in a further memory module operatively connected to the control unit.

In an advantageous embodiment, the method comprises, after phase c), the following phase: d) manually changing the order of and/or deleting one or more cooking cycles if the ordered list.

Preferably, after changing the order and/or deleting one or more cooking cycles, the sorting phase b) can be performed again.

In a further advantageous embodiment, the method comprises after phase c), the following phase: e) saving the ordered list of cooking cycles, sorted according to phase b), in a memory module of the cooking device.

Preferably, the method comprises, before phase a), the following phase: a0) setting, by the user interface, a new cooking cycle, and storing it in the database.

Preferably the cooking oven is provided with a temperature sensor, operatively connected to the control unit and configured for detecting the temperature within the cooking chamber.

Preferably the cooking oven is provided with a humidity sensor, operatively connected to the control unit and configured for detecting the humidity within the cooking chamber.

In a preferred embodiment, the sorting algorithm is configured for calculating the energy required for passing from a first cooking cycle to a second cooking cycle, as the result of a polynomial function whose variables are or depend on the difference between the pre-set final temperature of the first cooking cycle and the pre-set starting temperature of the second cooking cycle and on the difference between the pre-set final humidity of the first cooking cycle and the pre-set starting humidity of the second cooking cycle.

Preferably, the polynomial function is a second order polynomial function.

More preferably, the polynomial function has coefficients depending on experimental measurements operated when the cooking oven is empty.

Preferably, the polynomial function is the following:

$$E(\Delta T,H\Delta)=p_1\Delta T^2+p_2\Delta T\Delta H+p_3\Delta H^2+p_4\Delta T+p_5\Delta H+p_6$$

wherein:

E(ΔT, ΔH) is the energy variation for passing from a first cooking cycle to a second cooking cycle;

$p_1, p_2, \ldots p_6$ are the coefficient depending on experimental measurements operated when the cooking oven is empty;

ΔT is the temperature difference between the pre-set final temperature (Tf) of the first cooking cycle and the pre-set starting temperature (Ti) of the following second cooking cycle ΔH is the humidity difference between the pre-set final humidity (Hf) of the first cooking cycle and the pre-set starting Humidity (Hi) of the following second cooking cycle.

Preferably, the value of the temperature variation between a first and a second cooking cycle used as variable in the polynomial function for calculating the energy, is weighted for taking into account the ambient temperature T0, by the following formula:

$$\Delta T=\Delta T(1-T0/Ti)$$

wherein:

T0 is the environment temperature,

Ti is the starting temperature of the second cooking cycle.

Advantageously, the value of environment temperature can be set by the user for example by the user interface, or it can be measured, for example by a suitable temperature sensor provided in the cooking oven.

In an advantageous embodiment, the sorting algorithm is configured for sorting cooking cycles by applying a heuristic technique to the energy required for passing from a cooking cycle to another cooking cycle, in such a way to find a local minimum of the overall energy consumption for executing all the cooking cycles in sequence.

Preferably, the heuristic technique is the Karg-Thompson heuristic.

Advantageously, the heuristic technique is repeated a plurality of times starting with different random orders of the cooking cycles, and the selected order of the cooking cycles is the one taking to the minimum value of all the calculated local minimums of the overall energy consumption for executing all the cooking cycles in sequence.

In a further advantageous embodiment, the sorting algorithm is configured for calculating, for all the possible couples of cooking cycles in a list, the energy needed for passing from a cooking cycle to another cooking cycle, and sorting the cooking cycles in order to minimize the overall energy consumption for executing in sequence all the cooking cycles of the list.

Preferably, each of the cooking cycles is associated to a kind data related to a kind of cooking cycles it belongs to; in this case the sorting algorithm preferably bases the calculation of the order of the cooking cycles of the new list also on the kind data of the cooking cycles of the new list.

Advantageously, the kind data are stored in the database where the cooking cycles are store, preferably together with the rest of the data of the data related to the cooking cycles.

Advantageously, the control unit can be configured for detecting the value of the kind data associated to a cooking cycle.

In this case, in step b) the sorting algorithm advantageously forces all the cooking cycles associated to one or more prefixed kind data after the rest of the cooking cycles of the new list.

Preferably, the kind data can have only two logical values (e.g. YES or NOT, 1 or 0, etc.) indicating if the associated cooking cycle is configured for cooking foodstuff that, during the cooking cycle, soils the cooking oven in a particular way (corresponding for example to logical value YES, or 1), or not (corresponding for example to logical value NOT, or 0).

For example, a cooking cycle for roasted chicken, that typically soils the oven very much, can be associated to a kind data which logical value is "1", while a cooking cycle for cooking bread, that typically does not soil the oven, can be associated to a kind data which logical value is "0".

The sorting algorithm can be advantageously configured in such a way that when a cooking cycle to be sorted is associated to a kind data (e.g. having logical value "1") indicating that the cooking cycle soils the oven in a particular way, the algorithm forces this cooking cycle after all the cooking cycles associated to a kind data having a different value.

This sorting criteria ensures that all the cooking cycles that soil the oven are performed after all the cooking cycles that does not soil the oven, or that soil it in a minor way, so that it is not necessary performing the cleaning (or at least a deep cleaning) of the cooking oven between performing the cooking cycles of the new list.

It is underlined that the sorting algorithm, preferably, does not simply put the cooking cycles of a specific kind after the others, but it does the sorting taking anyway into account energy consumption; for example, in the passage form the last "clean" cooking cycle that does not soil the oven (or that anyway is associated to a kind data indicating that it can be performed before than other cooking cycles soiling the oven more that it), to the first "dirty" cooking cycle that soils the oven in a particular way (or that anyway is associated to a kind data indicating that it must be performed after the other cooking cycles soiling the oven less that it), the sorting algorithm takes into account the energy for passing from the last "clean cycle" to the first "dirty cycle", and selects the last "clean cycle" and the first "dirty cycle" in order to try to minimize the overall energy consumption.

In a further advantageous embodiment, each of the cooking cycles is associated to a status data related to the status of the food to be cooked by the cooking cycle, and the sorting algorithm bases the calculation of the order of the cooking cycles of the new list also on the status data related to the status of the food to be cooked by the cooking cycles of the new list.

Preferably, the status data indicates if the foodstuff to be cooked by the cooking cycle has to be loaded still frozen into the cooking chamber.

Advantageously, the status data are stored in the database where the cooking cycles are store, preferably together with the rest of the data of the data related to the cooking cycles.

Preferably, the status data can have only two logical values (e.g. YES or NOT, 1 or 0, etc.) indicating if the cooking cycle is configured for cooking still frozen foodstuff (corresponding for example to logical value YES, or 1) or not (corresponding for example to logical value NOT, or 0).

Advantageously, the control unit can be configured for detecting the value of the status data associated to a cooking cycle.

Preferably, in case the value of the status data indicates that the foodstuff has to be loaded in the cooking chamber still frozen, the sorting algorithm uses, as coefficients of the above mentioned polynomial function, values obtained by experimental measurements performed with frozen samples positioned within the cooking chamber during measurements.

In a preferred embodiment, the oven comprises a steam generator adapted to generate steam to be supplied to the cooking chamber, wherein one or more of the cooking cycles stored or storable in the database are steam programs comprising instructions for activating/deactivating, alternatively or in addition to the heating device, the steam generator; the control unit is configured for activating/deactivating the steam generator according to the steam programs.

In a further aspect thereof, the invention is related to a cooking oven comprising:

- a cooking chamber wherein foodstuff can be loaded;
- a heating device for heating foodstuff contained in the cooking chamber;
- a database wherein cooking cycles are stored, each cooking cycle having a pre-set starting temperature, a pre-set final temperature, a pre-set starting humidity, a pre-set final humidity;
- a control unit operatively connected to the database and to the heating device, configured for activating/deactivating the heating device according to the cooking cycles;
- a user interface operatively connected to the control unit, configured for allowing a user to interact with the control unit;
- optionally, a steam generator configured for producing steam, and fluidly connected to the cooking chamber so as to release into the latter the steam;
- wherein the control unit of the cooking oven is configured for implementing the method according to the invention.

These and other features and advantages of the invention will be better apparent from the following description of some exemplary and non-limitative embodiments, to be read with reference to the attached drawings, wherein.

Figure 1:
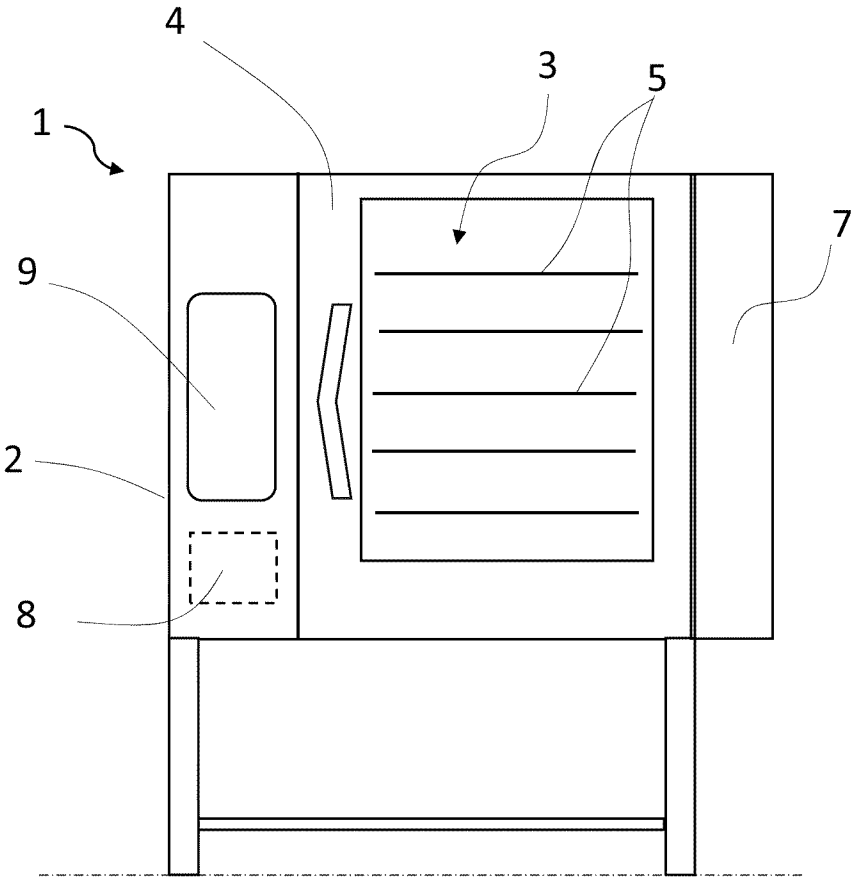
FIG. 1 is a schematic frontal view of an oven to which the method according to the invention can be applied.

With reference to FIG. 1, a cooking oven 1 to which the method according to the invention can be applied is schematically described.

The cooking oven 1 comprises an external casing 2, containing a cooking chamber 3, wherein foodstuffs can be placed for being cooked; preferably, the cooking chamber 3 is accessible via a door 4. Advantageously the cooking oven 1 is provided with a sensor, not illustrated, detecting the opened and closed state of the door 4.

In an advantageous embodiment, like in the example of attached figures, the cooking chamber 3 can contain a plurality of trays or racks 5, wherein foodstuff, or pots or trays containing foodstuff, can be placed for being cooked.

Figure 2:
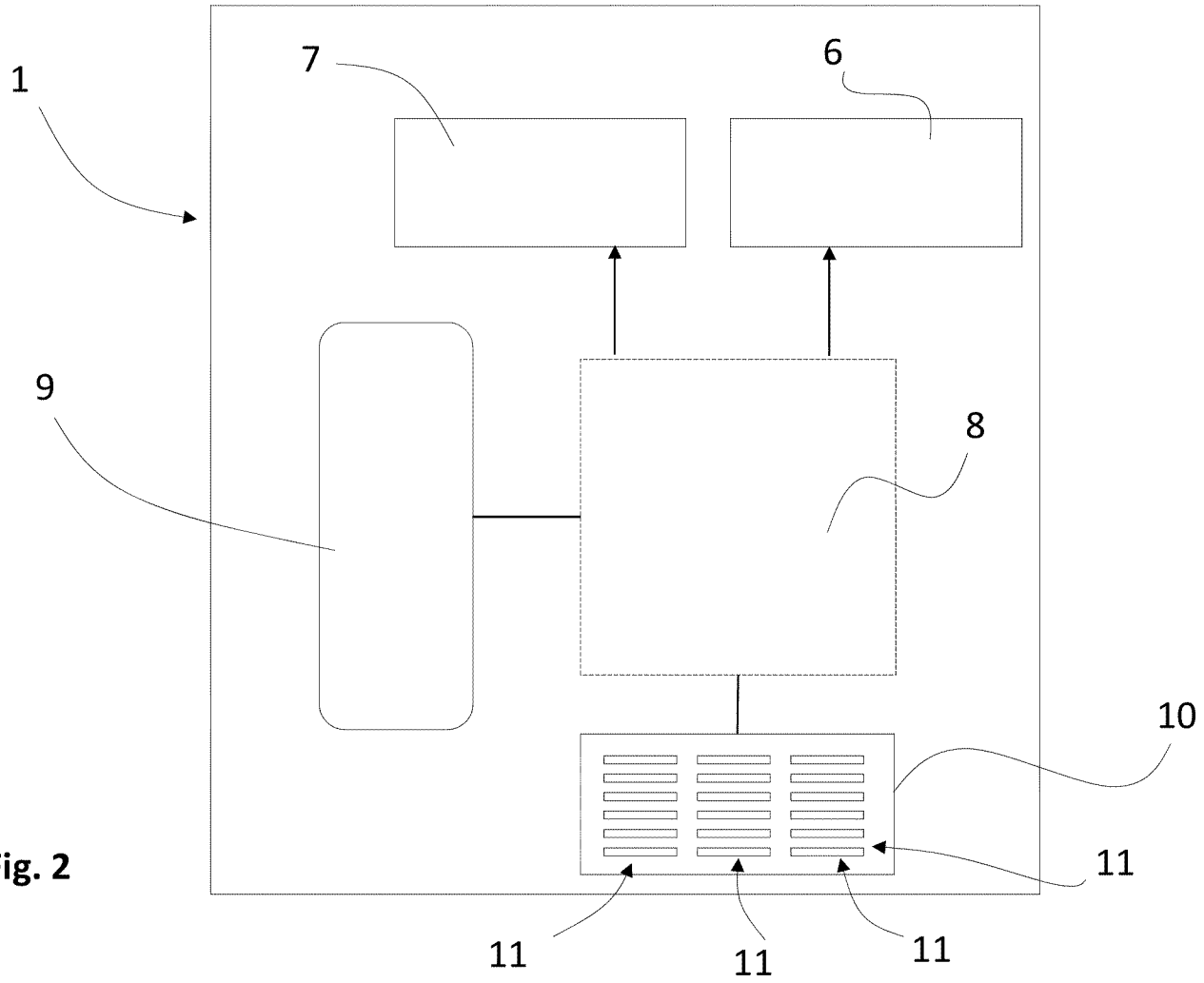
FIG. 2 is a schematic view of some components of the oven of FIG. 1.

The cooking oven 1 comprises a heating device 6, schematically illustrated in FIG. 2, e.g. an electric heater, or a gas heater, configured for heating the internal of the cooking chamber 3.

Preferably, but not necessarily, the cooking oven 1 comprises a steam generator 7 configured for producing steam, and fluidly connected to the cooking chamber 3 so as to release into the latter the steam. More preferably, the steam generator 7 comprises a water reservoir, not illustrated, fillable with water, and a water heater for heating water loaded within the water reservoir, also not illustrated.

Advantageously, the cooking oven 1 comprises a control unit 8, schematically illustrated in FIGS. 1 and 2 by a dashed square, comprising for example an electronic board, configured for controlling the electric and electronic components (e.g. heaters, electro-valves, switches, sensors, etc.) of the cooking oven 1.

Advantageously, the cooking oven 1 comprises a user interface 9, comprising for example a touch-screen, a display and a keyboard, switches, knob(s), etc., operatively connected to the control unit 8, and configured for allowing a user to interact with such a control unit 8.

Advantageously, the cooking oven 1 comprises a database, schematically illustrated in FIG. 2 with a rectangle 10, wherein cooking cycles (or programs), schematically illustrated in FIG. 2 with rectangles 11 are stored.

Advantageously, the database 10 can be stored/memorized in a suitable memory module, not illustrated, of the control unit 8, or in a further memory module operatively connected to the control unit 8.

Each cooking cycle 11 has a pre-set starting temperature ($T_i$), a pre-set final temperature ($T_f$), a pre-set starting humidity ($H_i$), a pre-set final humidity ($H_f$).

Advantageously, each cooking cycle 11 comprises instructions and/or a logic for obtaining in the cooking chamber 3 a temperature/humidity profile suitable for cooking a specific dish. Advantageously, the control unit is operatively connected to the heating device 6, and it is configured for activating/deactivating such heating device 6 according to the cooking cycles 11.

Advantageously the cooking oven 1 is provided with a temperature sensor and an humidity sensor, not illustrated, operatively connected to the control unit 8 and configured for detecting, respectively, the temperature and the humidity within the cooking chamber 3.

Advantageously, if the cooking oven is provided with a steam generator 7, some of the cooking cycles 11 can be steam cooking cycles, i.e. they comprise instructions and/or a logic for activating/deactivating, alternatively or in addition to the heating device 6, the steam generator 7, and the control unit 8 is configured for activating/deactivating the steam generator 7 according to these steam cooking cycles 11.

Preferably, but not necessarily, each of the cooking cycles 11 is associated to a kind data related to a kind of cooking cycles it belongs to.

Advantageously, the kind data are stored in the database 10 where the cooking cycles 11 are store, preferably together with the rest of the data of the data related to the cooking cycles 11.

Preferably, this kind data can have only two logical values (e.g. YES or NOT, 1 or 0, etc.) indicating if the associated cooking cycle 11 is configured for cooking foodstuff that, during the cooking cycle 11, soils the cooking oven in a particular way (corresponding for example to logical value YES, or 1) or not (corresponding for example to logical value NOT, or 0). For example, a cooking cycle 11 for roasted chicken, that typically soils the oven very much, can be associated to a kind data which logical value is "1", while a cooking cycle 11 for cooking bread, that typically does not soil the oven, can be associated to a kind data which logical value is "0".

Advantageously, the control unit 8 can be configured for detecting the value of the kind data associated to a cooking cycle 11.

In a further advantageous embodiment, each of the cooking cycles 11 is associated to a status data related to the status of the food to be cooked by the cooking cycle 11.

Preferably, the status data indicates if the foodstuff to be cooked by the cooking cycle 11 has to be loaded still frozen into the cooking chamber or not.

Advantageously, the status data are stored in the database 10 where the cooking cycles 11 are store, preferably together with the rest of the data of the data related to the cooking cycles 11.

Preferably, the status data can have only two logical values (e.g. YES or NOT, 1 or 0, etc.) indicating if the cooking cycle is configured for cooking still frozen foodstuff (corresponding for example to logical value YES, or 1) or not (corresponding for example to logical value NOT, or 0).

Advantageously, the control unit 8 can be configured for detecting the value of the status data associated to a cooking cycle 11.

Advantageously, one or more cooking cycles 11 can be stored by default in the database 10, so as to be available also at the first use of the cooking oven 1.

Preferably, the cooking oven 1 is configured in such a way that one or more further cooking cycles 11 can be set up (or programmed) by a user and stored in the database 10, preferably by using the user interface 9.

Preferably, one or more of the cooking cycles 11 stored in the database 10 can be modified by a user, for example by the user interface 9.

The functioning of the cooking oven 1 is the following: in a preferred embodiment, the user preferably selects, for example by the user interface 9 (which, in the example of attached figures, is advantageously a "touch-screen"), the activation of the method according to the invention. In the example of attached figures, the method can be advantageously activated by operating an input device, for example a first icon 12, preferably displayed in the user interface 9.

In the example of attached figures, after the user touches the first icon 12, preferably a second screen or window 13 appears on the user interface 9, which in the advantageous embodiment of attached Figures, displays a set 14 of previously sorted lists 15 of cooking cycles, advantageously in the form of icons (e.g. comprising writings and/or images).

Advantageously, the user can select, e.g. by touching the related icon, one of the previously sorted lists 15 on the user interface 9, which, preferably, causes a third screen or window 16 to appear in the user interface 9; this third screen or window 16 advantageously displays a plurality of cooking cycles 11, previously sorted in such a way to minimize the overall energy consumption.

Advantageously, the third screen or window 16 displays also a start icon 18, by activating which the first cooking cycle 11 in the list is activated.

The first cooking cycle 11 advantageously starts with a preheating phase, in which the heating element 6 and, if present in the cooking oven 1, and provided by the first cooking cycle 11, also the steam generator 7, are activated in order to obtain in the cooking chamber 3 the pre-set starting temperature Ti, and the pre-set starting humidity Hi provided for the first cooking cycle 11.

Once these pre-set starting temperature and humidity are reached (preferably measured by the temperature and humidity sensors of the cooking oven 1), a message is preferably displayed in the user interface 9, informing the user that the foodstuff can be loaded into the cooking chamber 3.

The user can load the foodstuff, and, after the door 4 is closed, the cooking cycle, controlled by the control unit 8, proceeds by activating/deactivating the heating element 6, and optionally, if present and provided by the cooking cycle, the steam generator 7.

Preferably, when the first cooking cycle is completed, a message, advantageously displayed in the user interface 9, informs the user that the foodstuff can be unloaded.

After the user has unloaded the foodstuff, and closed the door 4, the second cooking cycle in the list starts, by a possible preheating phase in which the heating element 6 and, if present in the cooking oven 1, and provided by the second cooking cycle, also the steam generator 7, are activated/deactivated, until reaching in the cooking chamber 3 the pre-set starting temperature Ti and the pre-set starting humidity Hi provided for the second cooking cycle.

Once the second cooking cycle is completed, the third is activated by the control unit 8, according to the same principle just explained in relation to the second cooking cycle in the list.

The procedure advantageously proceeds in the same way, until all the cooking cycles 11 in the list are executed.

A new list 21 of cooking cycles 11 to be executed in sequence, ordered in such a way to obtain a prefixed result, at least partially related to energy consumption (for example the minimization of the overall energy consumption for executing in sequence all the cooking cycles 11 of the new list 21, or a minimization of the overall energy consumption for executing in sequence all the cooking cycles 11 of the new list 21, subordinate to one or more not-energy-related constraints) can be created in the following way.

Figure 4:
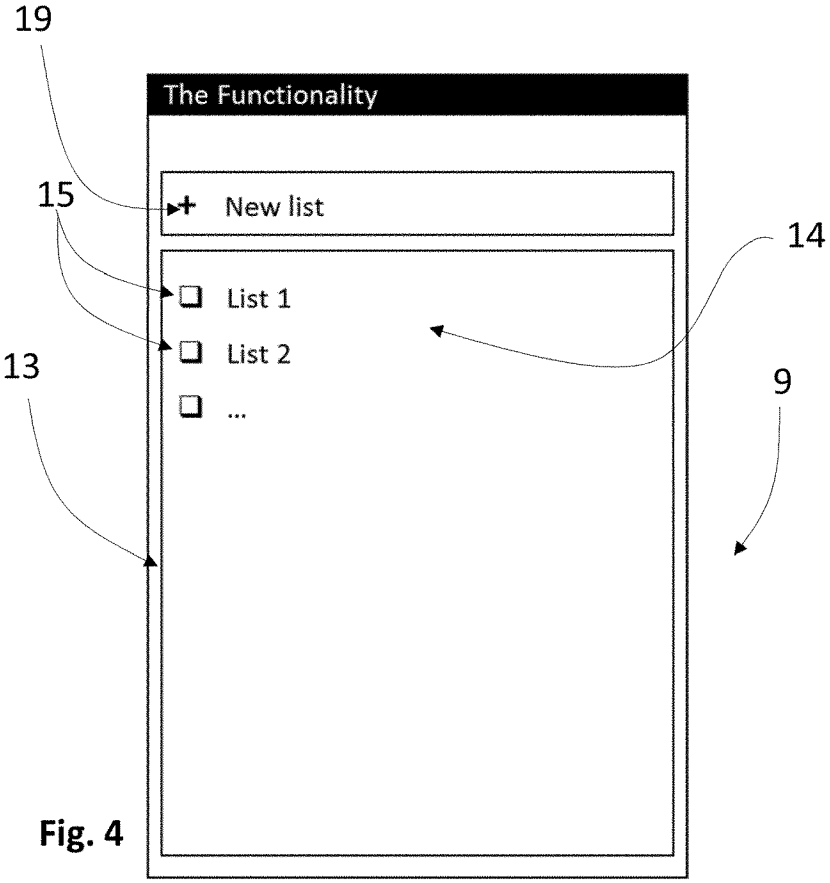
FIGS. 3 to 11 are schematic frontal views of the user interface of the cooking oven of FIGS. 1 and 2, in different phases of the method according to the invention.
Figure 3:
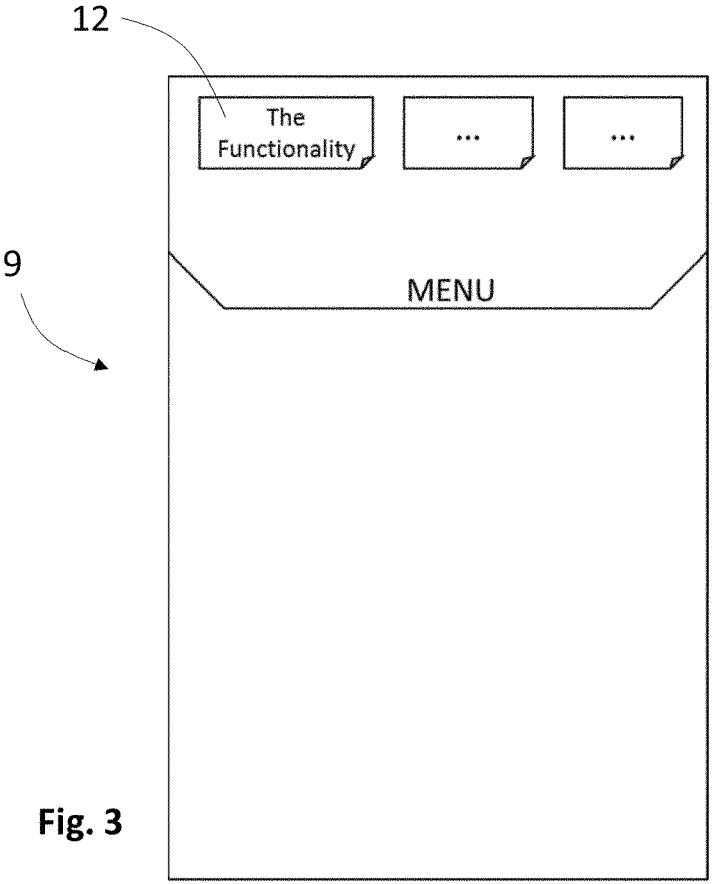
Figure 6:
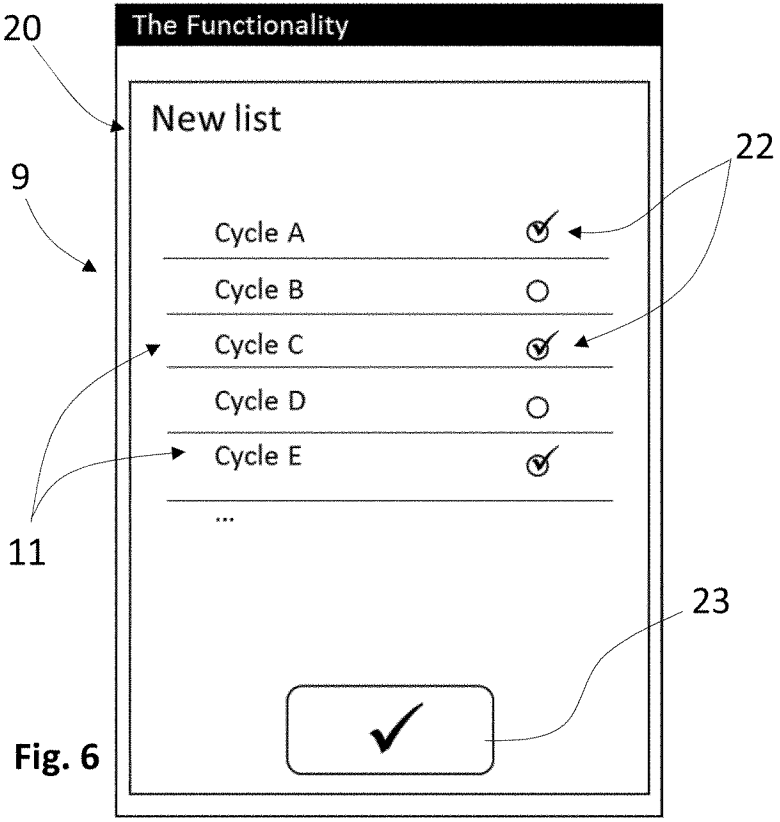

A suitable input device, for example an icon 19, preferably displayed in the second screen or window 13 (FIG. 4), is provided, which operation, preferably, makes a fourth screen or window 20 to be displayed in the user interface 9 (FIG. 6).

The fourth screen or window 20 advantageously displays all the cooking cycles 11 that can be selected; these cooking cycles 11 can comprise steam cooking cycles.

Advantageously, the cooking cycles 11 displayed in the fourth screen or window 20 can be pre-stored by default in the database 10, or they can have been set up by a user and stored in the database 10, preferably by using the user interface 9.

Advantageously, the cooking cycles 11 to be included in the new 21 list can be selected, for example, by checking a related selection field 22 displayed in the fourth screen or window 20, and more preferably by giving a confirmation command, for example by a further input device, for example a confirmation icon 23 displayed in the fourth screen or window 20.

Figure 7:
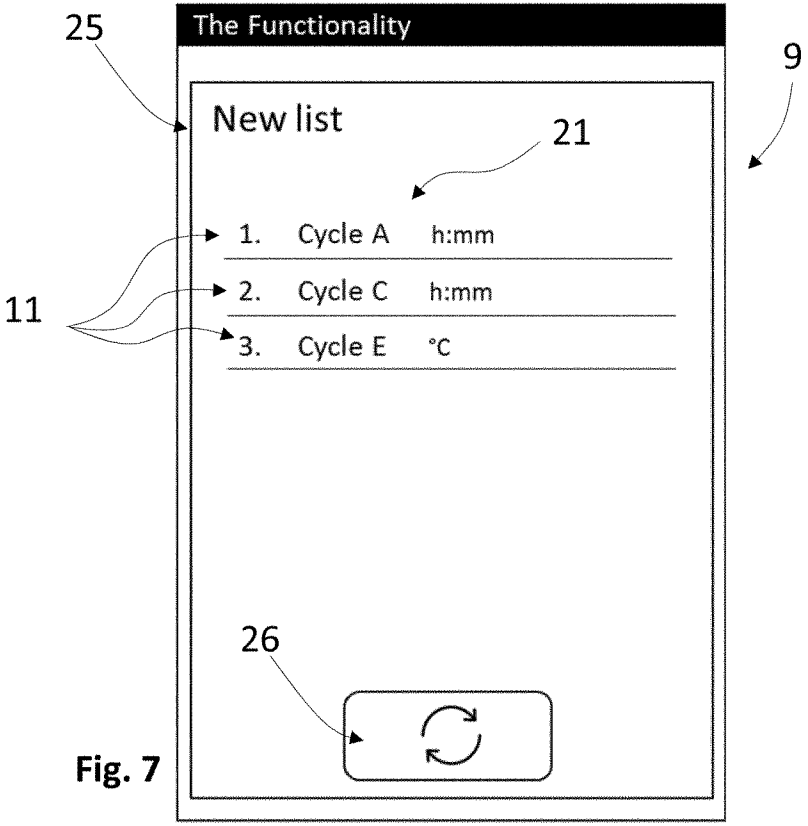

The operation of such confirmation icon 23 preferably, makes a fifth screen or window 25 to be displayed in the user interface 9 (FIG. 7), showing the selected cooking cycles 11 listed in a random order, for example corresponding to the selection order, or to their alphabetic order.

The cooking cycles 11 in the new list 21 can be therefore sorted in order to obtain a prefixed result, at least partially related to energy consumption, when all these coking programs 11 are performed in sequence.

A sorting input device is provided, advantageously a sorting icon 26, which operations by the user causes a sorting algorithm to be executed by the control unit 8.

The sorting algorithm calculates the order of the cooking cycles 11 of the new list 21 taking to a prefixed result, at least partially related to energy consumption, when performed in sequence; advantageously, the sorting algorithm calculates energy consumption basing the calculation on the pre-set starting temperature (Ti), pre-set final temperature (Tf), pre-set starting humidity (Hi) and pre-set final humidity (Hf) of the cooking cycles 11 contained in the new list 21.

In an advantageous embodiment, the sorting algorithm is configured for calculating the energy required for passing from a first cooking cycle to a second cooking cycle as the result of a polynomial function, preferably of the second order, which variables are or depend on the difference between the pre-set final temperature (Tf) of the first cooking cycle and the pre-set starting temperature (Ti) of the second cooking cycle, and are or depend on the difference between the pre-set final humidity (Hf) of the first cooking cycle and the pre-set starting humidity (Hi) of the second cooking cycle.

Figure 12:
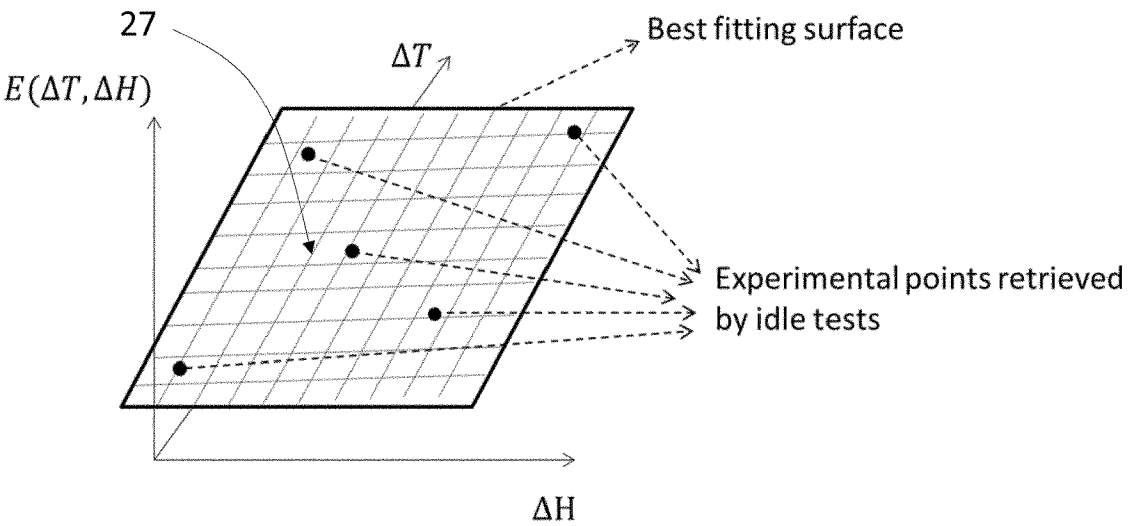
FIG. 12 is a schematic representation of an example of a surface interpolating experimental data in a cartesian space defined by the variation of temperature ($\Delta T$), variation of humidity ($\Delta H$), and variation of energy ($E(\Delta T, \Delta H)$) in a cooking oven to which the method according to the invention can be applied.

Preferably, such a polynomial function has coefficients depending on experimental measurements operated when the cooking oven 1 is empty (idle condition). In particular, these measurements can be executed by forcing a plurality of prefixed variations of temperature and humidity in the cooking chamber 3, and measuring the energy required for causing such variations; by repeating these measurements for many sets of temperature and humidity, it is possible to obtain, in the Cartesian space defined by the variation of temperature (ΔT), variation of humidity (ΔH), and variation of energy (E(ΔT, ΔH)) (see FIG. 12), an interpolation surface 27 from which it is possible to obtain the coefficients of the polynomial function.

Preferably, the polynomial function is the following:

$$E(\Delta T,H\Delta)=p_1A\tau^2+p_2\Delta T\Delta H+p_3\Delta H^2+p_4\Delta T+p_5\Delta H+p_6$$

wherein:

E(ΔT, ΔH) is the energy variation for passing from a first cooking cycle to a second cooking cycle;

$p_1, p_2, \ldots p_6$ are the coefficient depending on experimental measurements operated when the cooking oven is empty, as explained above;

ΔT is the temperature difference between the pre-set final temperature (Tf) of the first cooking cycle and the pre-set starting temperature (Ti) of the following second cooking cycle ΔH is the humidity difference between the pre-set final humidity (Hf) of the first cooking cycle and the pre-set starting Humidity (Hi) of the following second cooking cycle.

Preferably, the value of the temperature variation between a first and a second cooking cycle used as variable in the polynomial function for calculating the energy, is weighted for taking into account the ambient temperature T0, by the following formula:

$$\Delta T=\Delta T(1-T0/Ti)$$

wherein:

T0 is the environment temperature,

Ti is the starting temperature of the second cooking cycle.

In an advantageous embodiment, the sorting algorithm is configured for sorting cooking cycles 11 by applying a "heuristic technique" to the energy required for passing from a cooking cycle 11 to another cooking cycle 11, in such a way to find a local minimum of the overall energy consumption for executing all the cooking cycles 11 in sequence.

Preferably, the heuristic technique is the Karg-Thompson heuristic.

More preferably, the Karg-Thompson heuristic is repeated a plurality of times starting with different random orders of the cooking cycles 11, and the selected order of the cooking cycles 11 is the one taking to the minimum value of all the calculated local minimums of the overall energy consumption for executing all the cooking cycles 11 in sequence.

In a further advantageous embodiment, the sorting algorithm calculates, for all the possible couples of cooking cycles 11 of the new list 21, the energy needed for passing from a cooking cycle to another cooking cycle, and sorts the cooking cycles 11 in order to minimize the overall energy consumption for executing in sequence all the cooking cycles contained in the first list; this kind of sorting is more precise than the one using the heuristic technique, but it requires to be executed much more time and calculation resources.

Figure 8:
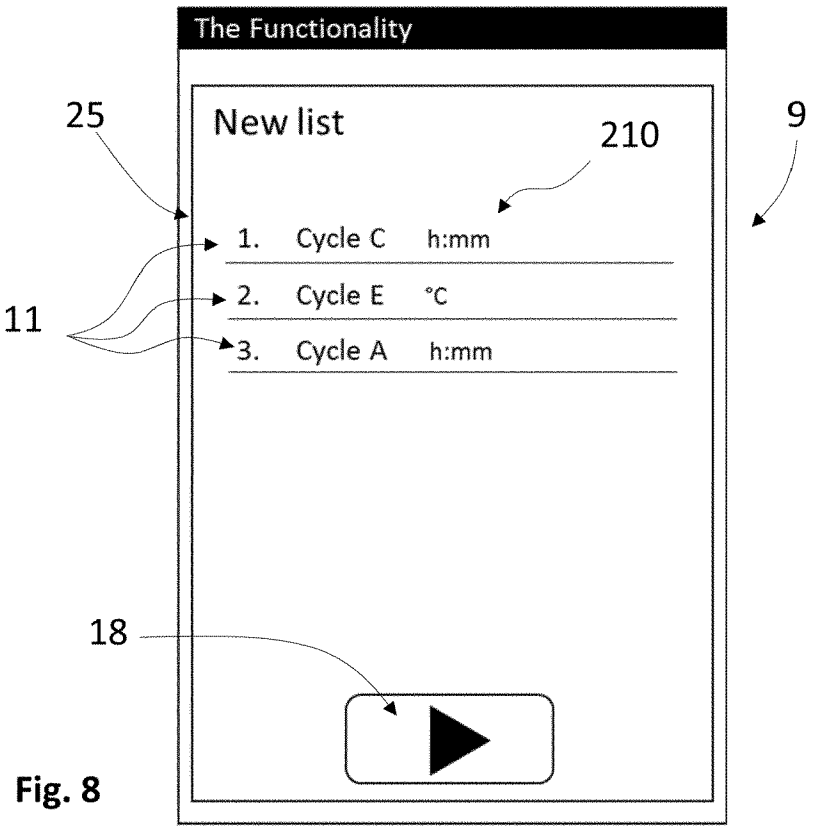

Once the sorting of the cooking cycles 11 has been performed, a sorted list 210 of cooking cycles 11 is displayed in the user interface 9, for example, as in the advantageous embodiments of attached figures, in the fifth screen or window 25 (FIG. 8).

In a further advantageous embodiment, in case a kind data is associated to the cooking cycles 11, the sorting algorithm can base the calculation of the order of the cooking cycles 11 of the new list 21 also on the kind data related to the cooking cycles 11 of the new list 21.

In this case, the sorting algorithm can be advantageously configured in such a way that when a cooking cycle 11 to be sorted is associated to a kind data (e.g. having logical value "1") indicating that such a cooking cycle 11 soils the oven in a particular way, the algorithm forces this cooking cycle 11 after all the cooking cycles 11 associated to a kind data having a different value.

This sorting criteria ensures that all the cooking cycles 11 that soil the oven are performed after all the cooking cycles 11 that does not soil the oven, or that soil it in a minor way, so that it is not necessary performing the cleaning (or at least a deep cleaning) of the cooking oven between performing the cooking cycles 11 of the new list 21.

It is underlined that the sorting algorithm, preferably, does not simply put the cooking cycles 11 of a specific kind after the others, but it does the sorting taking anyway into account energy consumption; for example, in the passage form the last "clean" cooking cycle 11 that does not soil the oven (or that anyway is associated to a kind data indicating that it can be performed before than other cooking cycles 11 soiling the oven more that it), to the first "dirty" cooking cycle 11 that soils the oven in a particular way (or that anyway is associated to a kind data indicating that it must be performed after the other cooking cycles 11 soiling the oven less that it), the sorting algorithm takes into account the energy for passing from the last "clean cycle" to the first "dirty cycle", and selects the last "clean cycle" and the first "dirty" cycle in order to try to minimize the overall energy consumption.

In a further advantageous embodiment, in case a status data is associated to the cooking cycles 11, and the value of the status data indicates that the foodstuff has to be loaded in the cooking chamber 3 still frozen, the sorting algorithm uses as coefficients of the above mentioned polynomial function values obtained by experimental measurements performed with frozen samples positioned within the cooking chamber 3 during measurements.

In the advantageous embodiment in which both a kind data and a status data are associated to the cooking cycles 11, the sorting algorithm is preferably configured for applying both above described sorting criteria, i.e. forcing the cooking cycles 11 having a first value of the kind data after all the cooking cycles 11 having a different value of the kind data, and using as coefficients of the above mentioned polynomial function values obtained by experimental measurements performed with frozen samples positioned within the cooking chamber 3 during measurements for sorting cooking cycles having a status value indicating that foodstuff has to be loaded in the cooking chamber 3 still frozen.

Figure 5:
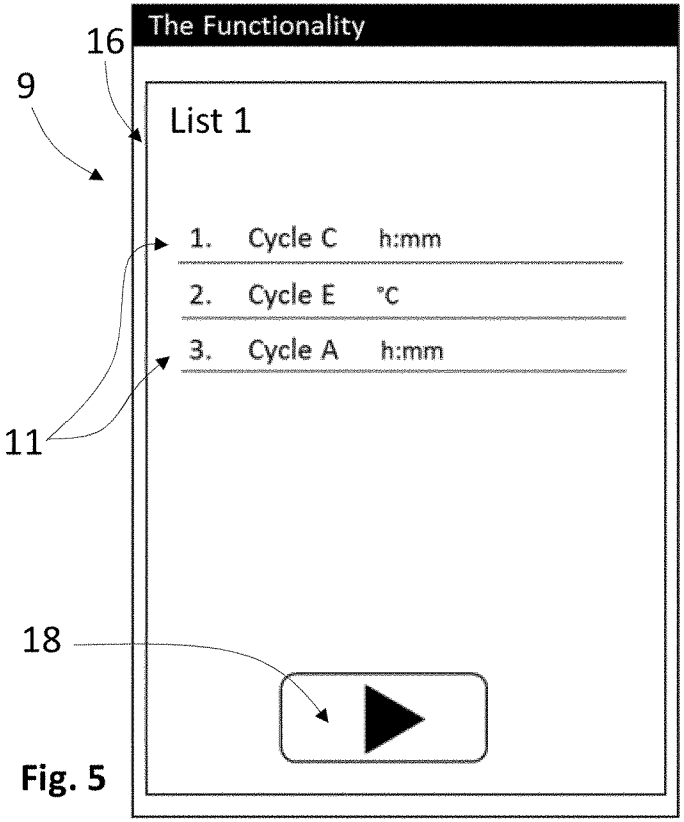

Once the sorted list 210 is displayed in the user interface 9, the first cooking cycle of the sorted list 210 can be activated, for example by operating a start icon 18 displayed in the fifth screen or window 25. Then the cooking procedure advantageously proceeds by executing in sequence all the cooking cycles of the sorted list 210, in the same way explained above in relation to FIG. 5.

Figure 9:
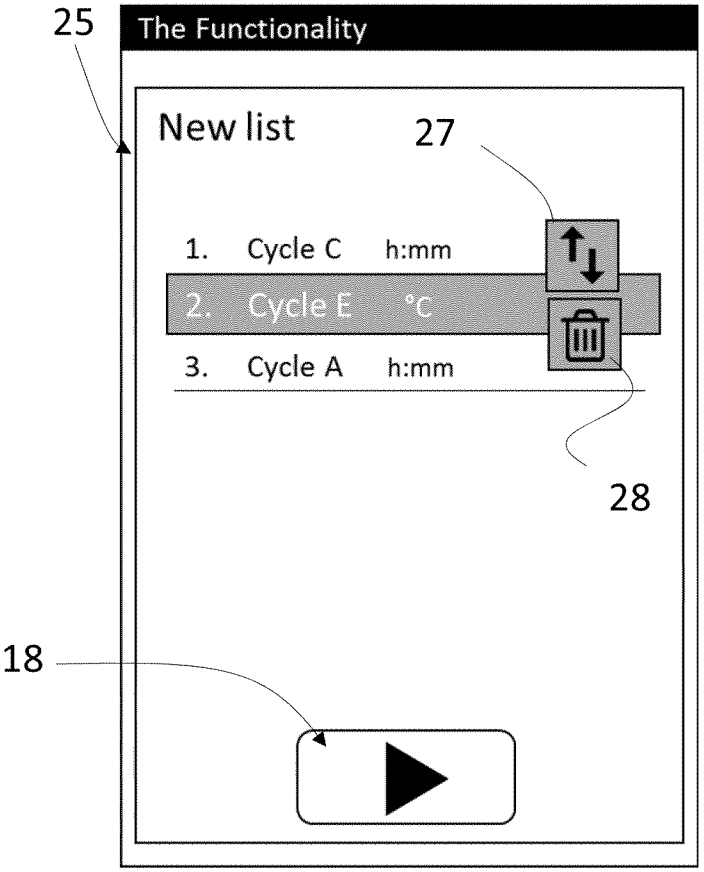

Preferably, before starting the first cooking cycle 11 of the sorted list 210, the order of the cooking cycles 11 can be manually modified (FIG. 9), for example by operating a moving input device provided in the user interface 9, for example a moving icon 27 displayed in the fifth screen or window 25.

Preferably, before starting the first cooking cycle 11 of the sorted list 210, one or more cooking cycles 11 can be manually removed from the new list 21 (FIG. 9), for example by operating a deleting input device provided in the user interface 9, for example a deleting icon 28 displayed in the fifth screen or window 25.

After moving and/or deleting one or more cooking cycles 11, the sorting phase can be performed once more, for example by operating a sorting-again input device provided in the user interface 9, for example a "sorting-again" icon 29 displayed in the fifth screen or window 25.

Figure 10:
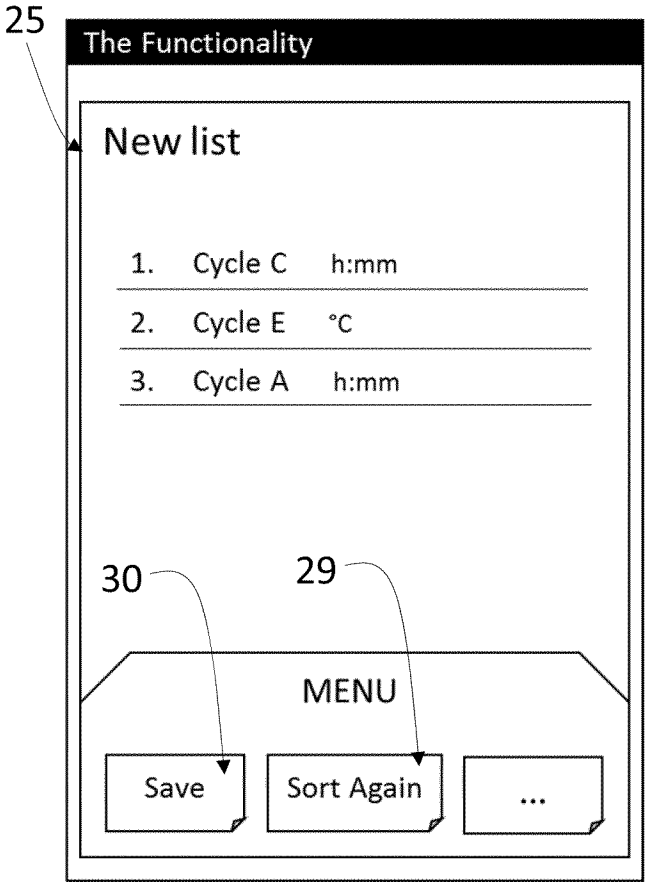

Once the user decides that the sorted list 210 is final, it can be saved in a memory unit, not illustrated, of the cooking oven 1, e.g. contained in the control unit 8, for example by operating a saving input device provided in the user interface 9, for example a saving icon 30 (FIG. 10).

After being saved, a sorted list 210 will advantageously appear among the set 14 of previously sorted lists 15 of cooking cycles that can be selected by the user.

Figure 11:
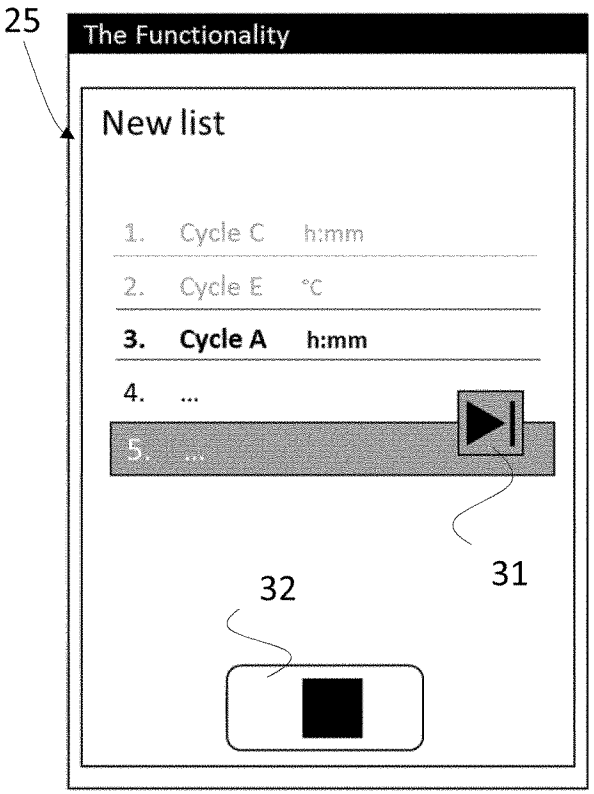

Preferably, during the execution of a cooking cycle 11, one or more cooking cycles 11 can be skipped, for example by operating a skipping input device provided in the user interface 9, for example a skipping icon 31 displayed in the fifth screen or window 25 (FIG. 11).

Preferably, during the execution of a cooking cycle 11 of a list, one or more cooking cycles can be stopped, for example by operating a stopping input device provided in the user interface 9, for example a stopping icon 32 displayed in the fifth screen or window 25 (FIG. 11).

It is seen therefore how the invention achieves the proposed aim and objects, there being provided a method for operating a cooking oven effectively taking to a prefixed result, at least partially related to the energy consumption, when a series of cooking cycles are executed in sequence.

The invention claimed is:

1. A method for operating a cooking oven (1), comprising:

a cooking chamber (3) wherein foodstuff is loaded;

a heating device (6) for heating foodstuff contained in said cooking chamber (3);

a database (10) wherein cooking cycles (11) are stored, each cooking cycle (11) having a pre-set starting temperature (Ti), a pre-set final temperature (Tf), a pre-set starting humidity (Hi), and a pre-set final humidity (Hf);

a control unit (8) operatively connected to said database (10) and to said heating device (6), wherein said control unit (8) is configured for activating/deactivating said heating device (6) according to said cooking cycles (11); and a user interface (9) operatively connected to said control unit (8), configured for allowing a user to interact with said control unit (8);

wherein the method comprises steps of (a) selecting, by said user interface (9), a new list (21) of two or more of said cooking cycles (11) stored in said database (10), to be executed in sequence, (b) sorting, by said control unit (8), said cooking cycles (11) of said new list (21), using a sorting algorithm that calculates an order of said cooking cycles (11) of said new list (21) taking to a prefixed result, at least partially related to energy consumption, when performed in sequence, basing the calculation on said pre-set starting temperature ($T_i$), said pre-set final temperature ($T_f$), said pre-set starting humidity ($H_i$), and said pre-set final humidity ($H_f$) of said cooking cycles (11) of said new list (21), wherein (i) said prefixed result comprises a minimization of an overall energy consumption for executing in sequence all said cooking cycles (11) of said new list (21), or a minimization of the overall energy consumption for executing in sequence all said cooking cycles (11) of said new list (21), subordinate to one or more not-energy-related constraints, and (ii) said sorting algorithm is configured for calculating an energy (E) required for passing from a first cooking cycle to a second cooking cycle, as a result of a polynomial function which variables are or depend on a difference between said pre-set final temperature (Tf) of said first cooking cycle and said pre-set starting temperature (Ti) of said second cooking cycle and on a difference between said pre-set final humidity (Hf) of said first cooking cycle and said pre-set starting humidity (Hi) of said second cooking cycle, and (c) displaying, via said user interface (9), a sorted list (210) containing said cooking cycles (11) of said new list (21), sorted according to step (b).

2. The method according to claim 1, and further comprising, after said step (c), a step of: (d) manually changing the order of and/or deleting one or more cooking cycles (11) of said sorted list (210).

3. The method according to claim 1, and further comprising, after said step (c), a step of: (d) saving said sorted list (210) of cooking cycles (11), sorted according to said phase (b), in a memory module of said cooking device (1).

4. The method according to claim 1, and further comprising, before said step (a), a step of: (a0) setting, by said user interface (9), a new cooking cycle (11), and storing it in said database (10).

5. The method according to claim 1, wherein said polynomial function has coefficients depending on experimental measurements operated when the cooking oven (1) is empty.

6. A method for operating a cooking oven (1), comprising:

a cooking chamber (3) wherein foodstuff is loaded;

a heating device (6) for heating foodstuff contained in said cooking chamber (3);

a database (10) wherein cooking cycles (11) are stored, each cooking cycle (11) having a pre-set starting temperature (Ti), a pre-set final temperature (Tf), a pre-set starting humidity (Hi), and a pre-set final humidity (Hf);

a control unit (8) operatively connected to said database (10) and to said heating device (6), wherein said control unit (8) is configured for activating/deactivating said heating device (6) according to said cooking cycles (11); and a user interface (9) operatively connected to said control unit (8), configured for allowing a user to interact with said control unit (8);

wherein the method comprises steps of (a) selecting, by said user interface (9), a new list (21) of two or more of said cooking cycles (11) stored in said database (10), to be executed in sequence, (b) sorting, by said control unit (8), said cooking cycles (11) of said new list (21), using a sorting algorithm that calculates an order of said cooking cycles (11) of said new list (21) taking to a prefixed result, at least partially related to energy consumption, when performed in sequence, basing the calculation on said pre-set starting temperature ($T_i$), said pre-set final temperature ($T_f$), said pre-set starting humidity ($H_i$), and said pre-set final humidity ($H_f$) of said cooking cycles (11) of said new list (21), wherein said sorting algorithm is configured for sorting cooking cycles (11) by applying a heuristic technique to an energy (E) required for passing from a cooking cycle (11) to another cooking cycle (11), in such a way to find a local minimum of an overall energy consumption for executing all the cooking cycles (11) in sequence.

7. The method according to claim 6, wherein said heuristic technique is repeated a plurality of times starting with different random orders of the cooking cycles (11), and a selected order of the cooking cycles (11) is one taking to a minimum value of all the calculated local minimums of the overall energy consumption for executing all the cooking cycles (11) in sequence.

8. The method according to claim 1, wherein said sorting algorithm is configured for calculating, for all possible couples of cooking cycles (11) in a list, an energy (E) needed for passing from a cooking cycle to another cooking cycle, and sorting said cooking cycles (11) in order to minimize an overall energy consumption for executing in sequence all the cooking cycles (11) of said list.

9. The method according to claim 1, wherein each of said cooking cycles (11) is associated to a kind data related to a kind of cooking cycles it belongs to, and wherein in said step (b) said sorting algorithm bases the calculation of the order of said cooking cycles (11) of said new list (21) also on said kind data of said cooking cycles (11) of said new list (21).

10. The method according to claim 9, wherein, in said step (b), said sorting algorithm forces all the cooking cycles (11) associated to one or more prefixed kind data to an end of the cooking cycles (11) of said new list (21).

11. The method according to claim 9, wherein said kind data has only two logical values indicating if the associated cooking cycle is configured for cooking foodstuff that, during the cooking cycle, soils the cooking oven in a particular way or not.

12. The method according to claim 1, wherein each of said cooking cycles (11) is associated to a status data related to a status of the food to be cooked by said cooking cycle (11), and wherein in said step (b), said sorting algorithm bases the calculation of the order of said cooking cycles (11) of said new list (21) also on said status data related to the status of the food to be cooked by said cooking cycles (11) of said new list (21).

13. The method according to claim 12, wherein said status data indicates if the foodstuff to be cooked by said cooking cycle (11) has to be loaded still frozen into the cooking chamber.

14. A method for operating a cooking oven (1), comprising:

a cooking chamber (3) wherein foodstuff is loaded;

a heating device (6) for heating foodstuff contained in said cooking chamber (3);

a steam generator (7) adapted to generate steam which is supplied to said cooking chamber (3);

a database (10) wherein cooking cycles (11) are stored, each cooking cycle (11) having a pre-set starting temperature (Ti), a pre-set final temperature (Tf), a pre-set starting humidity (Hi), and a pre-set final humidity (Hf);

a control unit (8) operatively connected to said database (10) and to said heating device (6) and said steam generator (9), wherein said control unit (8) is configured for activating/deactivating said heating device (6) and said steam generator (9) according to said cooking cycles (11); and a user interface (9) operatively connected to said control unit (8), configured for allowing a user to interact with said control unit (8);

wherein the method comprises steps of (a) selecting, by said user interface (9), a new list (21) of two or more of said cooking cycles (11) stored in said database (10), to be executed in sequence, (b) sorting, by said control unit (8), said cooking cycles (11) of said new list (21), using a sorting algorithm that calculates an order of said cooking cycles (11) of said new list (21) taking to a prefixed result, at least partially related to energy consumption, when performed in sequence, basing the calculation on said pre-set starting temperature ($T_i$), said pre-set final temperature ($T_f$), said pre-set starting humidity ($H_i$), and said pre-set final humidity ($H_f$) of said cooking cycles (11) of said new list (21), wherein (i) said prefixed result comprises a minimization of an overall energy consumption for executing in sequence all said cooking cycles (11) of said new list (21), or a minimization of the overall energy consumption for executing in sequence all said cooking cycles (11) of said new list (21), subordinate to one or more not-energy-related constraints, and (ii) said sorting algorithm is configured for calculating an energy (E) required for passing from a first cooking cycle to a second cooking cycle, as a result of a polynomial function which variables are or depend on a difference between said pre-set final temperature (Tf) of said first cooking cycle and said pre-set starting temperature (Ti) of said second cooking cycle and on a difference between said pre-set final humidity (Hf) of said first cooking cycle and said pre-set starting humidity (Hi) of said second cooking cycle, and (c) displaying, via said user interface (9), a sorted list (210) containing said cooking cycles (11) of said new list (21), sorted according to step (b).

* * * * *